US006292148B1

(12) United States Patent
Matsuura et al.

(10) Patent No.: US 6,292,148 B1
(45) Date of Patent: Sep. 18, 2001

(54) RADIO COMMUNICATION TERMINAL

(75) Inventors: Iwao Matsuura; Hideki Yagita, both of Kanagawa; Tadahisa Kamiya, Shizuoka, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/671,390

(22) Filed: Sep. 27, 2000

(30) Foreign Application Priority Data

Sep. 28, 1999 (JP) ..... 11-274330

(51) Int. Cl.[7] ..... H01Q 1/24
(52) U.S. Cl. ..... 343/702; 343/846
(58) Field of Search ..... 343/702, 900, 343/841, 846, 848; 455/90

(56) References Cited

U.S. PATENT DOCUMENTS 5,566,226 * 10/1996 Mizoguchi et al. ..... 379/58
5,821,903 * 10/1998 Williams ..... 343/702
5,949,379 * 9/1999 Yang ..... 343/702
6,189,056 * 2/2001 Ogura et al. ..... 710/62

* cited by examiner

*Primary Examiner*—Don Wong
*Assistant Examiner*—Hoang Nguyen
(74) *Attorney, Agent, or Firm*—Pearne & Gordon LLP

(57) ABSTRACT

When the antenna is extended, the length of the ½λ whip antenna 102 operates as an antenna thus causing only a negligible quantity of high-frequency currents to flow into the ground for the first circuit board 106. When the antenna is housed, the entire length of a ¼λ helical antenna 101 and a metalized ¼λ radial of the first enclosure 103 operates as an antenna thus causing only a negligible quantity of high-frequency currents to flow into the ground for the first circuit board 106. Because the length of the antenna is ½λ both when the antenna is extended and housed, only a negligible quantity of high-frequency currents to flow into the high-frequency circuit via the ground for the first circuit board 106.

7 Claims, 4 Drawing Sheets

RADIO COMMUNICATION TERMINAL

BACKGROUND OF THE INVENTION

The present invention relates to radio communication apparatus connected to information processing apparatus such as a personal computer and a PDA, characterized by a compact design for carry-along applications and reduction in a high-frequency noise component entering the high-frequency circuit of the main unit, the noise component originating from the control circuit of information processing apparatus such as a personal computer or a PDA and coming into a receiving frequency of the main unit.

Conventionally, it was a customary practice to use a ¼λ to ⅜λ whip antenna as an antenna for radio communication terminal apparatus where a high-frequency circuit, a communication control circuit, an antenna and a PCMCIA interface were integrated.

FIG. 4 shows a configuration of conventional radio communication terminal apparatus that uses a ¼λ whip antenna. The radio communication terminal apparatus is characterized in that a circuit board 131 is composed of a high-frequency circuit 130, a communication control circuit 132 and a PCMCIA interface 133 and that the antenna is integrated by connecting the high-frequency circuit 130 and the ¼λ whip antenna 126.

A ¼λ to ⅜λ whip antenna requires a favorable ground for operation as an antenna. For radio communication terminal apparatus that requires a compact design generally uses the ground for the circuit board 131 also as an antenna ground.

However, the conventional ¼λ to ⅜λ whip antenna requires a broad and stable ground surface in order to obtain stable characteristics. While the circuit board also plays the role of an antenna ground for radio communication terminal apparatus that requires a compact design, further downsizing is under way in recent radio communication terminal apparatus. This makes it difficult to provide a sufficiently stable and wide antenna ground.

For a one-piece design comprising a high-frequency circuit and a communication control circuit in radio communication terminal apparatus, there is a problem that, in case the role of an antenna ground was played by the ground for the communication control circuit, a high-frequency noise component enters the high-frequency circuit via the ground for the main unit, the noise component originating from the communication control circuit of the main unit and coming into a receiving frequency of the main unit.

Also in case radio communication terminal apparatus is connected to information processing apparatus such as a personal computer and a PDA, there is a problem that a high-frequency noise component enters the high-frequency circuit via the ground for the main unit, the noise component originating from the control circuit of the information processing apparatus and coming into a receiving frequency of the main unit.

Thus, incasea high-frequency component noise originating from the communication control circuit of radio communication terminal apparatus or from the control circuit of the information processing apparatus and coming into a receiving frequency of the main unit is a noise signal whose frequency is the same as the receiving frequency, there arises a problem of a cochannel suppression interference.

SUMMARY OF THE INVENTION

The invention solves the problem and aims at providing excellent radio communication terminal apparatus that can reduce a high-frequency noise component entering the high-frequency circuit via the ground for the main unit, the noise component originating from the control circuit, without impairing antenna characteristics.

The first aspect of the invention is radio communications apparatus wherein a first enclosure comprising an antenna and a high-frequency circuit and a second enclosure comprising a communication control circuit and a PCMCIA interface are coupled via a hinge, the apparatus portable as a PCMCIA card size unit when the enclosures and folded, in that the internal surface of the first enclosure and the second enclosure is made of a metal or resin that is metal-plated or metalized, that the internal surface of the first enclosure is designed to use part of the first enclosure as an antenna ground when the antenna is housed, that the high-frequency ground for the first and second enclosures is separated at the central hinge in order to prevent high-frequency currents flowing through the ground for the antenna from flowing into the second enclosure, thus reducing a noise originating from the control circuit of the information processing apparatus or from the communication control circuit of the main unit as a coupling quantity entering the antenna or the ground for the antenna, and that the radio communications apparatus is connected to the information processing apparatus via the PCMCIA interface thus confining a noise originating inside the second enclosure via a shielded structure of the internal surface of the second enclosure.

Via this configuration, a noise originating from the control circuit of the information processing apparatus such as a personal computer or a PDA or from the communication control circuit of the main unit can be reduced as a coupling quantity entering the antenna or the ground for the antenna, thus suppressing the influence of a harmonic noise originating from the control circuit coming into the receiving spectrum of the main unit.

The second aspect of the invention is radio communications apparatus according to the first aspect of the invention, in that a battery is mounted on the first enclosure.

Via this configuration, communication time or wait time can be extended for radio communication terminal apparatus with high current consumption.

The third aspect of the invention is radio communications apparatus according to the second aspect of the invention, in that the power supply for the information processing apparatus is used to recharge the battery.

Via this configuration, a battery mounted onto the first enclosure can be recharged by using the power supply for information processing apparatus such as a personal computer and a PDA.

The fourth aspect of the invention is radio communication terminal apparatus according to any of the first through third aspects of the invention, in that the length of the antenna attached to the first enclosure is a length that is within the maximum longitudinal length of the first enclosure when the antenna is housed.

Via this configuration, the length of a antenna assumed when the antenna is extended can be maximized.

The fifth aspect of the invention is radio communication terminal apparatus according to the fourth aspects of the invention, in that the apparatus uses a telescopic rod antenna reaching a length of ½λ of the service frequency when the antenna is extended.

Via this configuration, by making the length of the antenna ½λ of the service frequency, it is possible to prevent unwanted high-frequency currents from flowing into the ground for the circuit board.

The sixth aspect of the invention is radio communication terminal apparatus according to the fifth aspect of the invention, in that the apparatus comprises a mechanism whereby the antenna can be rotated 360 degrees when the antenna is extended.

Via this configuration, by adjusting the position of the antenna while the first enclosure is at a given angle, the best receiving field can be obtained.

DETAILED DESCRIPTION OF THE PREFERRED EMBODIMENTS

Embodiments of the invention will be explained below with reference to FIG. 1 through FIG. 4.

First Embodiment

Figure 1:
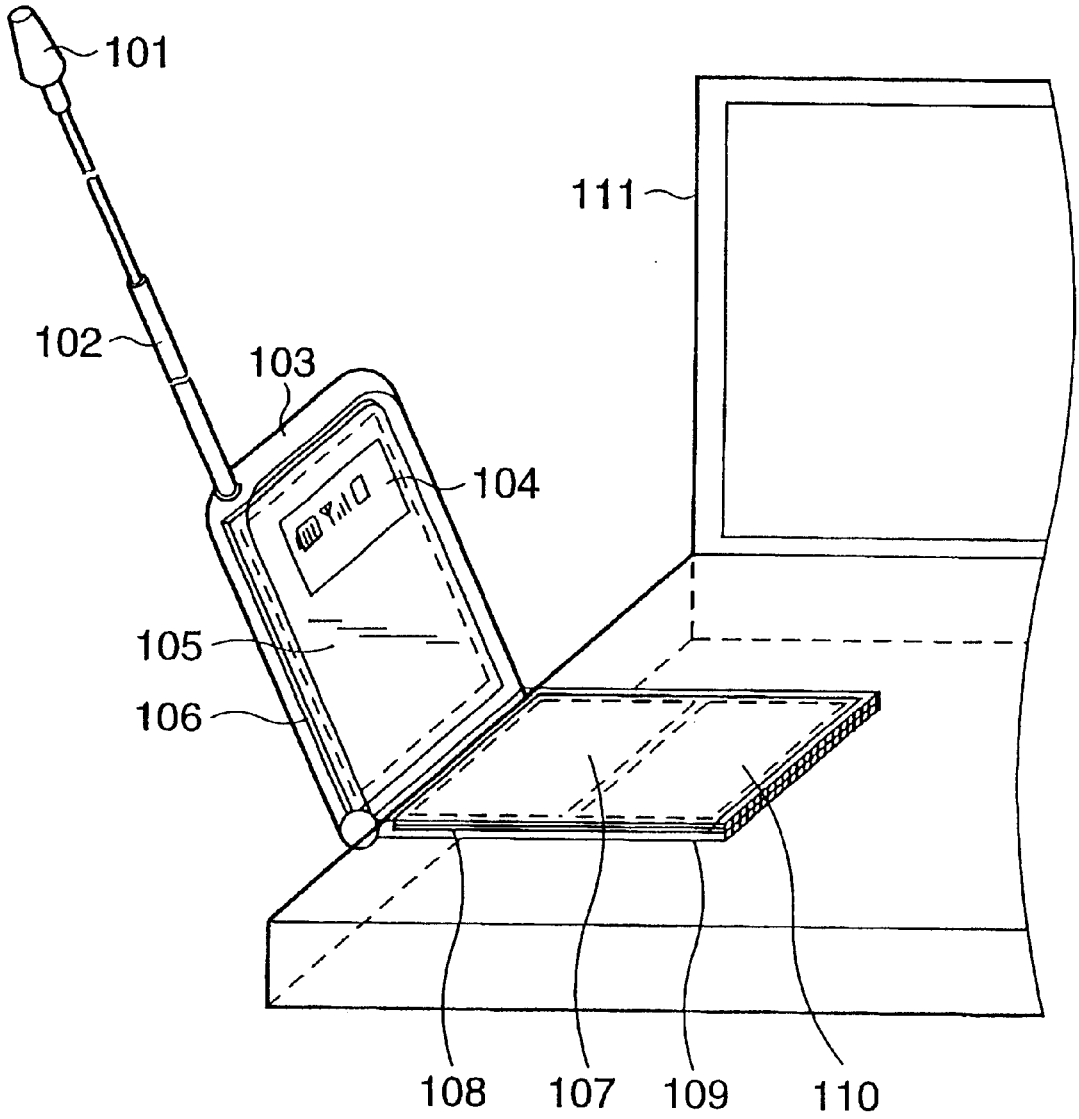
FIG. 1 shows a configuration of radio communication terminal apparatus according to the first embodiment of the invention.

FIG. 1 shows a configuration of radio communication terminal apparatus according to the first embodiment of the invention. In FIG. 1, the configuration related to the radio communication terminal apparatus comprises a ¼λ helical antenna 101, a ½λ whip antenna 102, a first enclosure 103, an LCD 104, a high-frequency circuit 105, a first circuit board 106, a communication control circuit 107, a second circuit board 108, a second enclosure 109, and a PCMCIA interface 110.

Operation of the antenna in such a configuration of radio communication terminal apparatus will be explained.

A first enclosure 103 comprising an antenna (101, 102) and a high-frequency circuit 105 and a second enclosure 109 comprising a communication control circuit 107 and a PCMCIA interface 110 are coupled to form a one-piece structure via a hinge. As the ground for an antenna attached to the first enclosure, the internal surface of the first enclosure 103 is made of a metal or resin that is metal-plated or metalized (see FIG. 2), and used as a ground for the antenna at a length of ¼λ of the service frequency. By adjusting the position of the antenna while the first enclosure is at a given angle via a mechanism whereby the antenna can be rotated 360 degrees, the best receiving field can be obtained.

The high-frequency ground for the first enclosure 103 and the second enclosures 109 is separated at the central hinge in order to prevent high-frequency currents flowing through the ground for the antenna from flowing into the second enclosure 109.

When the antenna is extended, the length of the ½λ whip antenna 102 operates as an antenna thus causing only a negligible quantity of high-frequency currents to flow into the ground for the first circuit board 106. When the antenna is housed, the entire length of a ¼λ helical antenna 101 and a metalized ¼λ radial of the first enclosure 103 operates as an antenna thus causing only a negligible quantity of high-frequency currents to flow into the ground for the first circuit board 106.

Because the length of the antenna is ½λ both when the antenna is extended and housed, only a negligible quantity of high-frequency currents to flow into the high-frequency circuit via the ground for the first circuit board 106.

Figure 2:
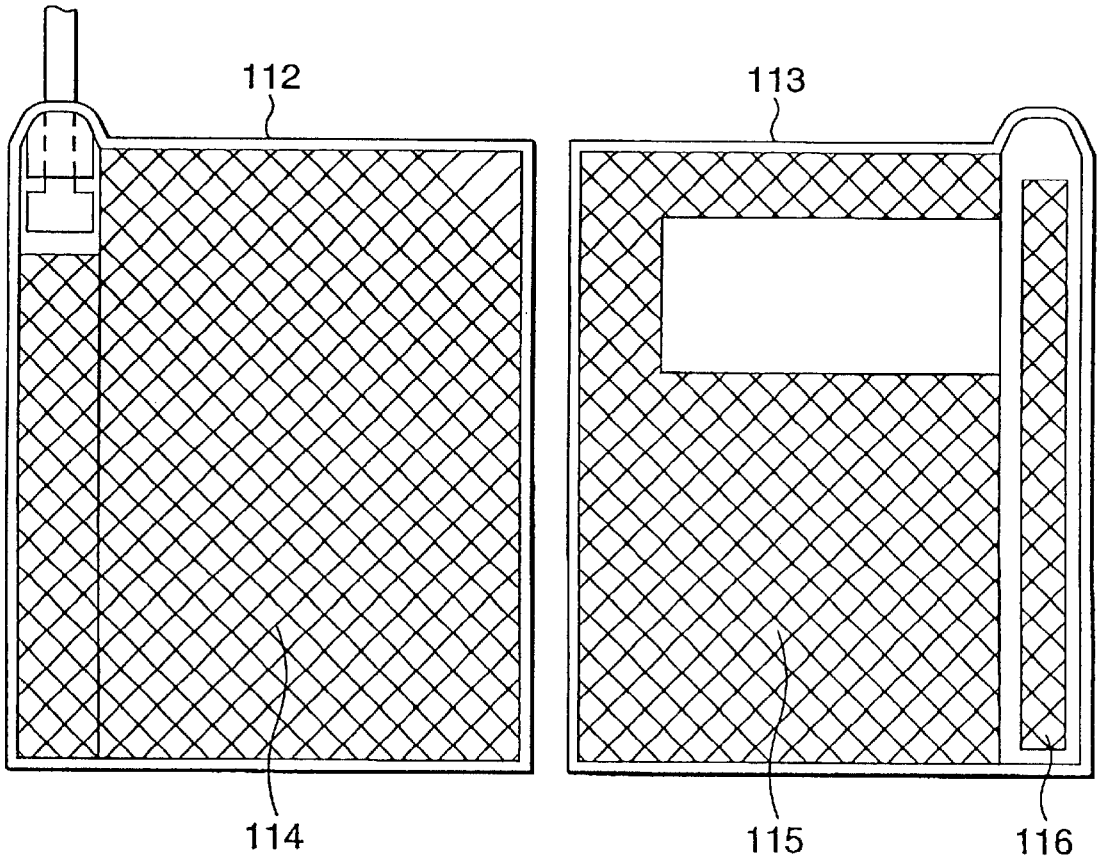
FIG. 2 shows a configuration of a metalized section of the first enclosure of radio communication terminal apparatus according to the second embodiment of the invention.

FIG. 2 shows a configuration of a metalized section of the first enclosure of radio communication terminal apparatus according to the embodiment of the invention. In FIG. 2, the configuration related to the metalized section of the first enclosure of radio communication terminal apparatus comprises an enclosure section 1-B 112, an enclosure section 1-A 113, a first metalized section 114, a second metalized section 115, and a third metalized section 116.

Configuration of the metalized sections and the feature will be explained below.

The enclosure section 1-A 113 is composed of a second metalized section 115 and a third metalized section 116.

The second metalized section 115 is adapted to operate as a shield for the entire apparatus and the third metalized section 116 as a ground for the antenna and has a length of ½λ of the service frequency.

The enclosure section 1-B 112 is composed of a first metalized section 114 and adapted to operate as a shield for the entire apparatus.

Figure 3:
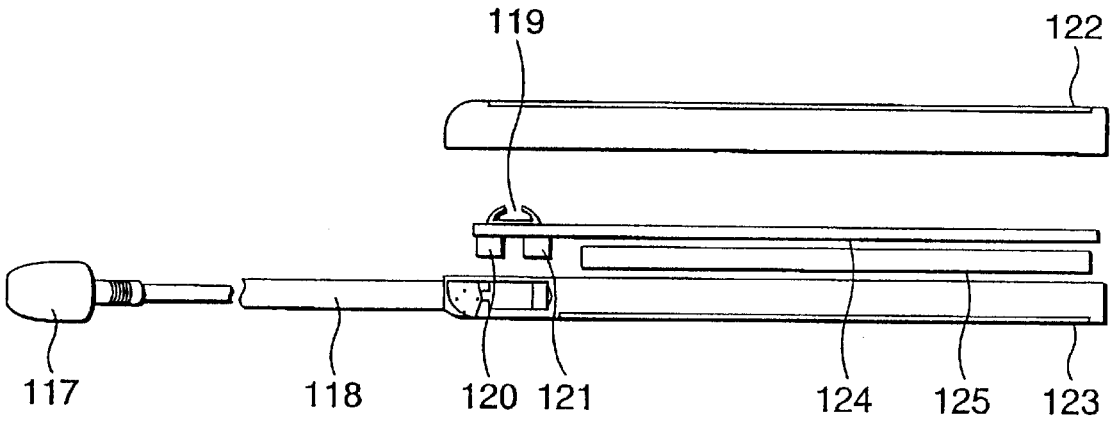
FIG. 3 is a sectional view, seen from the side of the first enclosure of a configuration of radio communication terminal apparatus according to the first embodiment of the invention.
Figure 4:
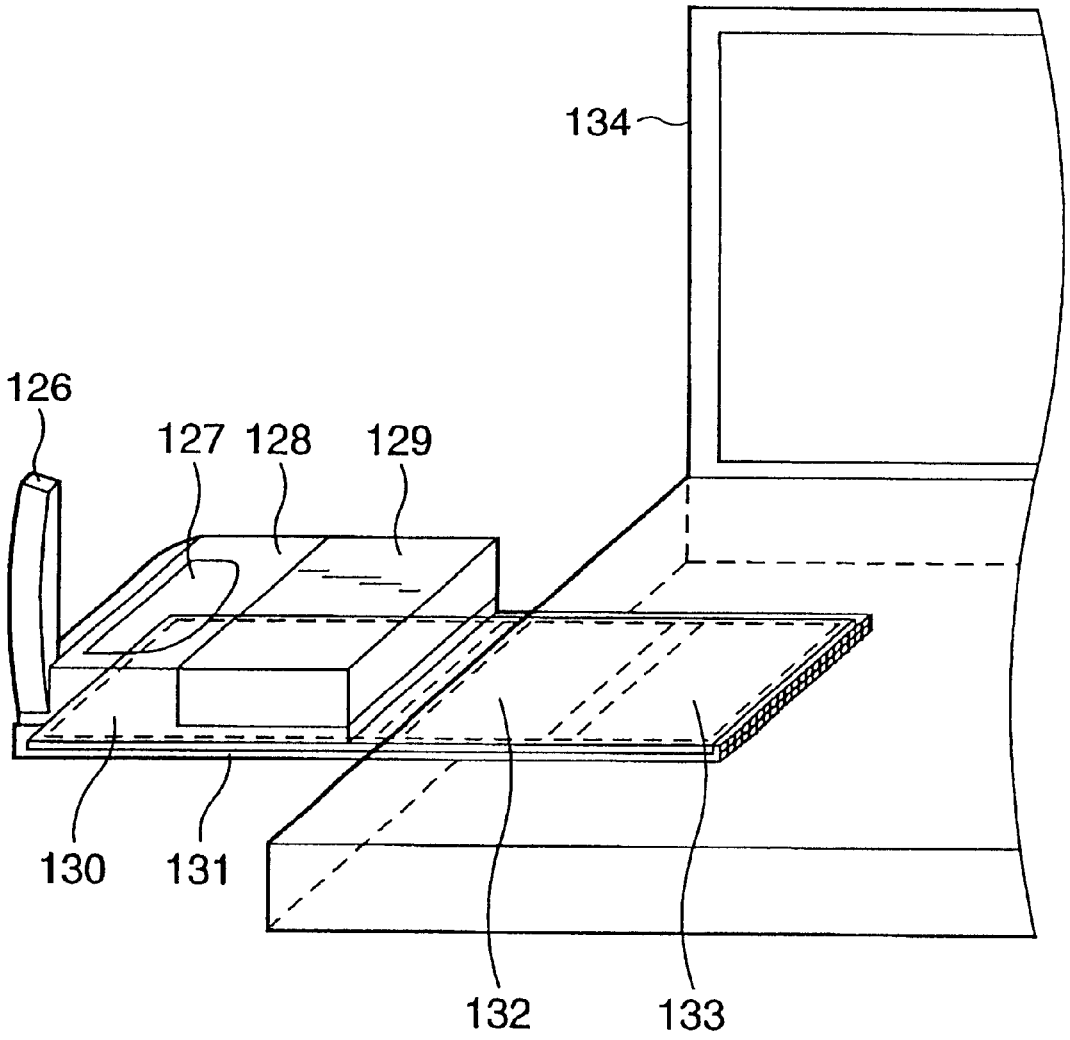
FIG. 4 shows a configuration of conventional radio communication terminal apparatus that uses a ¼λ whip antenna.

FIG. 3 is a sectional view, seen from the side of the first enclosure, of a configuration of radio communication terminal apparatus according to the first embodiment of the invention. In FIG. 3, the configuration related to the radio communication terminal apparatus comprises a ¼λ helical antenna 117, a ½λ whip antenna 118, a first contact spring 119, a second contact spring 120, a third contact spring 121, an enclosure section 1-A 122, an enclosure section 1-B 123, a first circuit board 124, and an antenna guide 125.

When the antenna is extended, the feeding point of the ½λ whip antenna 118 makes contact with the third contact spring 121, not with the second contact spring 120. The third contact spring 121 is connected to a matching circuit (not shown) used when the ½λ whip antenna 118 is selected.

When the antenna is housed, the feeding point of the ¼λ helical antenna 117 makes contact with the second contact spring 120, not with the third contact spring 121. The second contact spring 120 is connected to a matching circuit (not shown) used when the ¼λ helical antenna 117 is selected. When the antenna is housed, the ½λ whip antenna 118 is housed in the antenna guide 125.

The first contact spring 119 makes contact with the metalized ground for the enclosure section 1-A 122 (see the third metalized section 116 in FIG. 2) and mainly operates as a ground used when the ¼λ helical antenna 117 is selected.

Additionally, according to the present invention, a battery may be mounted on the first enclosure. Via this configuration, communication time or wait time can be extended for radio communication terminal apparatus with high current consumption.

Furthermore, the power supply for the information processing apparatus may be used to recharge the battery. Via this configuration, a battery mounted on the first enclosure can be recharged by using the power supply for information processing apparatus such as a personal computer and a PDA.

As mentioned earlier, the invention provides excellent radio communication apparatus. In the apparatus, by providing a separate high-frequency ground for the first enclosure and a separate one for the second enclosure, high-frequency currents are prevented from flowing into information processing apparatus such as a personal computer and a PDA. Electrical operation length of the antenna is made to reach ½λ of the service frequency in the first enclosure and is arranged outside information processing apparatus such as a personal computer and a PDA so that the noise source is placed at a distance from the current loop of the antenna, thus reducing a high-frequency noise component entering the high-frequency circuit via the ground for the circuit board, the noise component originating from the control circuit, without impairing antenna characteristics.

What is claimed is:

1. Radio communications apparatus comprising:

a first enclosure including an antenna portion, a high-frequency circuit and a first conductive member formed on an internal surface of said first enclosure; and a second enclosure including a communication control circuit, an interface portion, and a second conductive member formed on an internal surface of said second enclosure; and a hinge portion which couples said first enclosure and said second enclosure to be able to hold into small size unit, wherein in case of said antenna portion being housed, said internal surface of said first enclosure is used part of said first enclosure as an antenna ground while the high-frequency ground for said first and second enclosures is separated at the central hinge in order to prevent high-frequency currents flowing through the ground for the antenna from flowing into said second enclosure, whereby reducing a noise originating from the control circuit of the information processing apparatus or from the communication control circuit of the main unit as a coupling quantity entering said antenna or the ground for the antenna, and that said radio communications apparatus is connected to said information processing apparatus via the interface thus confining a noise originating inside said second enclosure via a shielded structure of said internal surface of said second enclosure.

2. Radio communications apparatus according to claim 1, wherein a battery is mounted on the first enclosure.

3. Radio communications apparatus according to claim 2, wherein the power supply for the information processing apparatus is used to recharge said battery.

4. Radio communication terminal apparatus according to any of claims 1 through 3, wherein the length of the antenna attached to said first enclosure is a length that is within the maximum longitudinal length of said first enclosure when said antenna is housed.

5. Radio communication terminal apparatus according to claim 4, wherein said apparatus portion comprises a extendable rod antenna having a length of ½λ of the service frequency when said antenna is extended.

6. Radio communication terminal apparatus according to claim 5, wherein said hinge portion comprises a mechanism whereby said antenna can be rotated 360 degrees when said antenna is extended.

7. Radio communication terminal apparatus according to claim 1, wherein said first and second conductive member is made of a metal or resin with metal-plated or metal-deposition.

* * * * *